US005082175A

United States Patent [19]

Koch et al.

[11] Patent Number: 5,082,175

[45] Date of Patent: Jan. 21, 1992

[54] HEATING DEVICE, PARTICULARLY VEHICLE HEATING DEVICE

[75] Inventors: Peter Koch, Munich; Guenter Kahnau, Soecking; Peter Glaser, Munich; Georg Habbel, Neuried; Stefan Kunz; Bernhard Schmatelka, both of Munich, all of Fed. Rep. of Germany

[73] Assignee: Webasto Ag Fahrzeugtechnik, Stockdorf, Fed. Rep. of Germany

[21] Appl. No.: 448,365

[22] Filed: Dec. 11, 1989

[30] Foreign Application Priority Data

Jan. 10, 1989 [DE] Fed. Rep. of Germany ..... 3900438

[51] Int. Cl.[5] ..... G05D 23/00

[52] U.S. Cl. ..... 237/12.3 C; 126/110 B

[58] Field of Search ..... 237/12.3 C, 12.3 R, 237/2 A, 12.3 B; 126/110 C, 110 B, 110 D

[56] References Cited

U.S. PATENT DOCUMENTS 2,780,218 2/1957 Allen ..... 126/110 B 4,703,888 11/1987 Kawamura et al. ..... 237/12.3 C

FOREIGN PATENT DOCUMENTS 3807190 9/1989 Fed. Rep. of Germany .

*Primary Examiner*—Henry A. Bennett

*Attorney, Agent, or Firm*—Sixbey, Friedman, Leedom & Ferguson

[57] ABSTRACT

A heating device (1) is provided with a sleeve member (14) surrounding a burner element (10) of the heating device, such that a combustion air chamber (15), having a predetermined volume coordinated to the respective configuration of the burner, is obtained between the burner element (10) and the sleeve member (14). The sleeve member (14) may be radially divided into two parts (14*a*, 14*b*), which parts are tightened against each other for sealing purposes. At a front end, the combustion air chamber (15) is defined by a cover (16) having an inlet opening (17) for the combustion air, which inlet opening is sealed relative to the environment and is connected with the outlet of a combustion air blower. The sleeve member (14) may be made of a light metal, such as aluminum or an aluminum alloy.

21 Claims, 1 Drawing Sheet

HEATING DEVICE, PARTICULARLY VEHICLE HEATING DEVICE

BACKGROUND OF THE INVENTION

The invention relates to a heating device, particularly a vehicle auxiliary heating device, having a burner element in a burner head housing, the burner element opening into a combustion chamber defined by a combustion pipe, which pipe is contained in a housing of the heating device to which the burner head housing is connected. The combustion air supplied by a combustion air blower of the heating device subsequently enters into the combustion chamber from a combustion air chamber surrounding the burner element.

In my previous German laid-open Patent Application No. 38 07 190.8, a heating device, particularly a vehicle heating device of the kind mentioned above, is described. The referenced application describes a burner element which, by means of a press device can be pressed in an axial direction toward the combustion pipe for the purpose of installation. The press device presses the burner element against the correspondingly defined bearing surfaces of the burner head housing component, whereby the burner head housing component on one hand, and the outer surfaces of the burner element on the other hand, define the chamber into which the combustion air enters from the combustion air blower, which air subsequently enters the burner element.

In connection with this concept, it was found that, in the optimal use of such a heating device, with respect to low pollution and efficient combustion operation, difficulties were encountered in that the combustion airflow around the burner element is dependent upon the shape and size of the burner head housing component. Also, there is direct contact between the burner head housing component and the burner element. Such contact permits transfer of heat to the burner element via the burner head housing component, which also contains the waste gas exhaust outlet of the heating device.

SUMMARY OF THE INVENTION

Accordingly, the invention has a primary objective of providing a heating device, particularly a vehicle heating device, which overcomes the previously described problems and which offers a more favorable combustion airflow to the burner, particularly with a view to optimization of burner capacity and pollution reduction.

In accordance with a preferred embodiment of the invention, a vehicle auxiliary heating device having a burner element opening into a combustion chamber defined by a combustion pipe, which pipe is contained in a housing of the heating device to which a burner head housing containing the burner element is connected, is provided with a combustion air chamber and wherein combustion air enters into a space formed by a sleeve member that surrounds the burner element en route to the combustion chamber. In this a way, the combustion air chamber is defined, of a predetermined volume, between an inner surface of the sleeve member and the outer surface of the burner element.

Accordingly, the heating device of the invention has the advantage that, independent of the size and the design of the burner head housing, a combustion air chamber is formed surrounding the burner element, whose volume can be predetermined in advance and, thus, can be adapted to the design and the desired capacity of the heating device. In this manner, the heating device of the present invention obtains a defined combustion airflow to the burner element which is largely independent of the configuration and arrangement of the burner head housing. Furthermore, the burner of the inventive heating device is designed such that the sleeve component, with the burner element, forms a complete functional unit whose operability can be tested independent of the heating device housing, prior to its installation into the heating device.

Preferably, the outer surface of the sleeve member contacts the inner surface of the burner head housing component. As a result of the air space between the burner element and the sleeve member, through which combustion air flows, a thermal separation is achieved. As a result, the burner head housing component is not in direct heat-conducting connection with the burner element, thereby permitting the burner to be operated substantially free of temperature influences from the burner head housing component.

According to a further feature of the invention, the sleeve member is radially divided, or subdivided, i.e., along transversely extending plane, thereby facilitating easy installation of the sleeve member, and, more particularly, additionally facilitating an arrangement of the sleeve member such that other components of the burner, like the flame monitor, ignition device, etc. can be supported by the burner sleeve member. Preferably, the plane of division is obliquely inclined relative to the center longitudinal axis of the sleeve member so as to form sleeve member portions that can be tightened against each other to provide a tight seal along the plane of division.

Advantageously, the combustion air chamber is closed at a front end by a cover that cooperates with the burner head housing for sealing the front end of the combustion air space relative to the environment. An inlet opening can be provided in the cover, via which the combustion air can be introduced into the combustion air chamber from a combustion air blower. Preferably, the cover and the inlet are sealed from the environment by means of a ring gasket. Such an arrangement causes the combustion air to be introduced into the combustion air chamber in a predetermined flow direction, resulting in a substantially low-loss combustion air supply, thereby favorably reducing energy consumption by the combustion air blower. In a preferred manner, the combustion air is introduced into the combustion air chamber via the inlet opening, such that the combustion air is directed to an outer surface of the burner element.

These and further objects, features and advantages of the present invention will become more obvious from the following description when taken in connection with the accompanying drawings which show, for purposes of illustration only, a single embodiment in accordance with the present invention.

BRIEF DESCRIPTION OF THE DRAWING

The sole figure of the drawing shows an axial, sectional view of a portion of a heating device having a burner, in accordance with the present invention.

DETAILED DESCRIPTION OF THE PREFERRED EMBODIMENT

Figure 1:
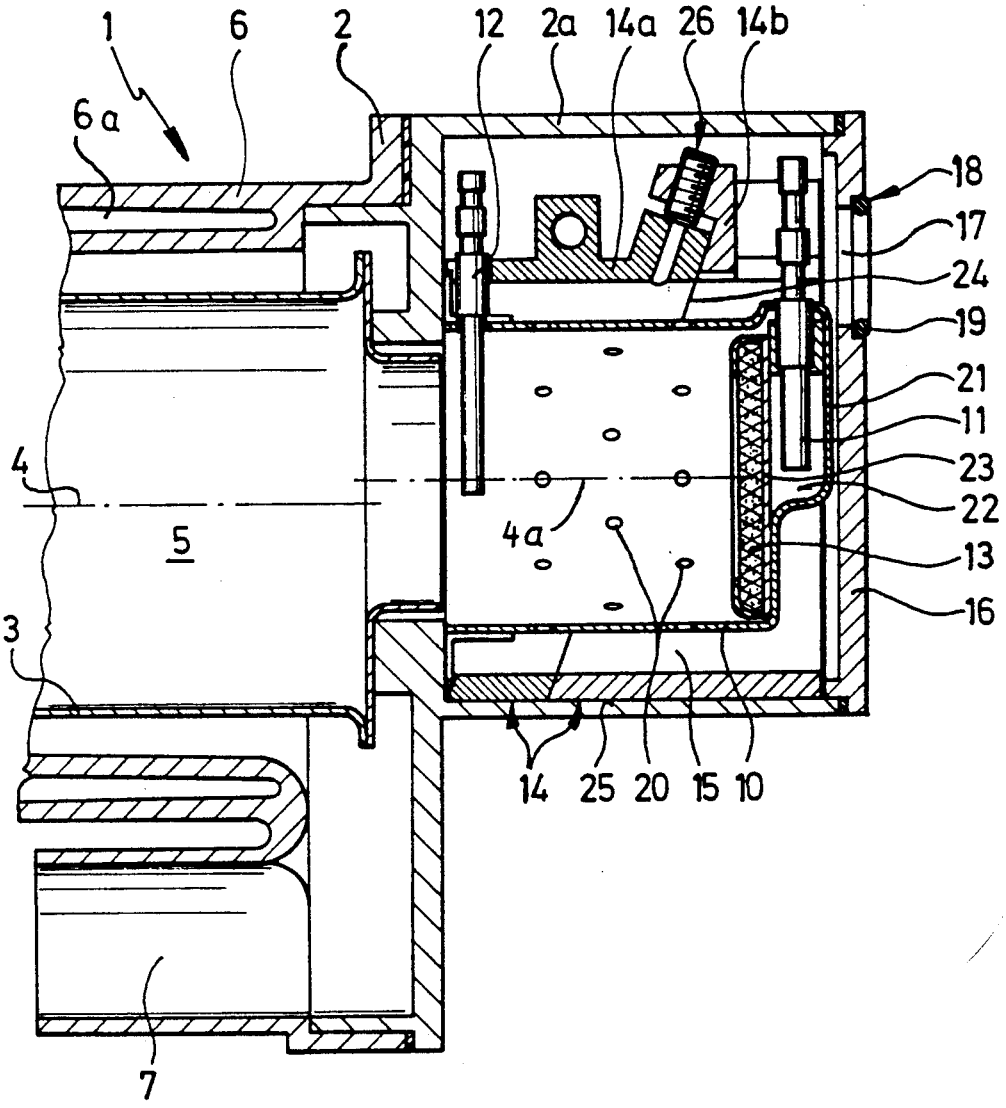

FIG. 1 shows a section of a heating device, designated 1 as a whole. A combustion pipe 3 is disposed in a housing component 2 in coaxial relationship with regard to the center longitudinal axis 4 of heating device 1. The combustion pipe 3 defines a combustion chamber 5, and is surrounded by a heat exchanger 6 which, in the illustrated embodiment, is formed as part of housing component 2. A burner head housing part 2*a* is provided on the front end of housing component 2.

In the example shown in the drawing, a so-called "water heating device" is depicted, operating with a liquid heat exchange medium which flows through an intermediate space 6*a* of the heat exchanger 6 of housing component 2. The hot combustion gases produced in combustion chamber 5 yield heat to the liquid heat exchange medium at heat exchanger 6, thereby causing it to heat up for the intended purpose of heating the vehicle. The hot combustion gases leave heating device 1, via exhaust gas outlet 7, after a reversing of their flow direction at the downstream end of the combustion chamber 5, as is known. The inlet and the outlet for the heat exchange medium are not identified in the drawing, as they are outside the drawing plane, but they are also of conventional construction.

Numeral 10 designates a burner element which represents the actual device producing the flame. An ignition device 11, consisting, for example, of a glow plug, and a flame monitor 12, project into the burner element. The type of the burner shown is a so-called vaporization burner having an absorbent body 13. The absorbent body 13 is arranged upstream of the ignition device 11 in burner element 10, and serves the purpose of effecting vaporization of the fuel supplied which, preferably, should be a liquid fuel, and is supplied by a fuel pump and fuel line, such as is shown in my above-noted earlier application.

As shown in the drawing, a sleeve member, designated 14, as a whole, surrounds burner element 10 and is disposed concentrically thereto, thus forming a combustion air chamber 15 between the burner component 10 and sleeve member 14, by way of an annular clearance therebetween. The front end of chamber 15 is closed by a cover 16, which sealingly is connected with the burner head housing component 2*a* via a gasket. Cover 16 has an inlet opening 17 which communicates with an outlet of a combustion air blower (not shown). For the purpose of sealing this connection with respect to the environment, a seal 18, in the form of ring gasket 19, is mounted in opening 17. Via this inlet 17, combustion air is introduced in a low-loss manner into the combustion air chamber 15 by the inserted outlet duct of the combustion air blower, such that the combustion air stream is directed onto the outer surface of burner element 10.

Openings 20 are distributed across the circumferential surface of burner element 10, via which combustion air is introduced into the interior of burner element 10. Furthermore, another opening 21 is provided in burner element 10 in proximity to ignition device 11. Opening 21 serves to introduce combustion air into an ignition chamber 22, which is formed around the ignition device and is defined in the burner element by a carrier 23 for the absorbent body 13.

The sleeve member 14 is radially divided into two mating parts, 14*a* and 14*b*. Sleeve member 14, appropriately, at least partially, contacts the inner surface of burner head housing part 2*a* and is supported thereby. The plane of division 24 of parts 14*a*, 14*b* is obliquely inclined relative to an outer surface 25 of sleeve member 14 and the center longitudinal axis 4*a* of burner element 10. Furthermore, a tightening device 26 is provided, by means of which components 14*a* and 14*b* of sleeve member 14 can be forced against each other, by producing an extension of sleeve member 14 that increases the abutment force of its ends against the facing end walls of burner head housing part 2*a* and cover 16, so as to obtain a tight seal in the area of the plane of division 24.

Additionally, component 14*a* of sleeve member 14, simultaneously, serves as a carrier for flame monitor 12, while component 14*b* faces cover 16 and houses ignition device 11. In such a manner, the sleeve component 14, together with the burner element 10, forms a complete functional unit which can be operationally tested independent of the housing of the heating device 1, prior to its installation into the heating device.

Sleeve member 14, as a whole, or at least one component 14*a*, 14*b* of sleeve member 14, is made of a light metal, for example aluminum or an aluminum alloy, thereby reducing the weight of the sleeve member 14.

Sleeve component 14, provided in accordance with the invention, forms an annular space around burner element 10 that serves as a combustion air chamber whose volume can be adapted to the respectively desired heating device configuration to achieve optimization of the burner's fuel properties. Furthermore, as the predetermined air volume of the combustion air chamber 15 is essentially independent of the size and design of the burner head housing 2*a*, it can be selected so that air volumes having a tendency to cause vibrations can be avoided, resulting in a quiet operation of the heating device. Furthermore, the sleeve member 14 facilitates a thermal separation of the burner element 10 with respect to the housing component 2 and the burner head housing part 2*a*, thereby resulting in the burner being extensively unaffected by temperature influences from housing component 2.

It is to be understood that the present invention is not limited to the features and embodiments described above, but that, for example, sleeve member 14 may be of any design which achieves the invention's objective, i.e., that a chamber having a predetermined volume of the combustion air be formed around the burner element 10. Thus, the present invention should be considered as encompassing the full scope of the appended claims.

We claim:

1. A vehicle heating device having a burner element opening into a combustion chamber defined by a combustion pipe that is disposed in a housing component of the heating device, and said burner element being contained in a burner head housing part of the heating device; wherein a sleeve member is provided which encloses the burner element within the burner head housing part and defines a combustion air chamber of predetermined value between an inner surface of the sleeve member and an outer surface of the burner element; and wherein the sleeve member at least partially contacts an inner surface of the burner head housing.

2. Heating device according to claim 1, wherein the sleeve part is radially divided into two components.

3. Heating device according to claim 2, wherein a plane of division between the two components of the sleeve part is obliquely inclined relative to an outer surface of the sleeve part and a center longitudinal axis of the burner element.

4. Heating device according to claim 3, wherein tightening means is provided for tightening of the two components of the sleeve member against each other.

5. Heating device according to claim 4, wherein the combustion air chamber is defined at a front end by a cover which cooperates with the burner head housing part.

6. Heating device according to claim 5, wherein an inlet opening is formed in the cover as a means for enabling combustion air to enter into the combustion air chamber.

7. Heating device according to claim 6, wherein seal means is provided for sealing the inlet opening in the cover relative to the environment.

8. Heating device according to claim 7, wherein said seal means is a ring gasket.

9. Heating device according to claim 4, wherein the sleeve member is formed of a light metal.

10. Heating device according to claim 9, wherein said light metal is selected from the group, consisting of aluminum and aluminum alloys.

11. A vehicle heating device having a burner element opening into a combustion chamber defined by a combustion pipe that is disposed in a housing component of the heating device, and said burner element being contained in a burner head housing part of the heating device; wherein a sleeve member is provided which encloses the burner element within the burner head housing part and defines a combustion air chamber of predetermined value between an inner surface of the sleeve member and an outer surface of the burner element; wherein the sleeve part is axially divided into two components.

12. Heating device according to claim 11, wherein a plane of division between the two components of the sleeve part is obliquely inclined relative to an outer surface of the sleeve part and a center longitudinal axis of the burner element.

13. Heating device according to claim 12, wherein tightening means is provided for tightening of the two components of the sleeve member against each other.

14. Heating device according to claim 1, wherein the combustion air chamber is defined at a front end by a cover which cooperates with the burner head housing part.

15. A vehicle heating device having a burner element opening into a combustion chamber defined by a combustion pipe that is disposed in a housing component of the heating device, and said burner element being contained in a burner head housing part of the heating device; wherein a sleeve member is provided which encloses the burner element within the burner head housing part and defines a combustion air chamber of predetermined value between an inner surface of the sleeve member and an outer surface of the burner element wherein the combustion air chamber is defined at a front end by a cover which cooperates with the burner head housing part; and wherein an inlet opening is formed in the cover as a means for enabling combustion air to enter into the combustion air chamber.

16. Heating device according to claim 15, wherein seal means is provided for sealing the inlet opening in the cover relative to the environment.

17. Heating device according to claim 16, wherein said seal means is a ring gasket.

18. A vehicle heating device having a burner element opening into a combustion chamber defined by a combustion pipe that is disposed in a housing component of the heating device, and said burner element being contained in a burner head housing part of the heating device; wherein a sleeve member is provided which encloses the burner element within the burner head housing part and defines a combustion air chamber of predetermined value between an inner surface of the sleeve member and an outer surface of the burner element; wherein the sleeve member is formed of a light metal.

19. Heating device according to claim 18, wherein said light metal is selected from the group, consisting of aluminum and aluminum alloys.

20. Heating device according to claim 1, wherein said heating device is of the vaporization burner type, and wherein a fuel absorbent vaporization body is disposed in an upstream end portion of the burner element.

21. A vehicle heating device having a burner element opening into a combustion chamber defined by a combustion pipe that is disposed in a housing component of the heating device, and said burner element being contained in a burner head housing part of the heating device; wherein a sleeve member is provided which encloses the burner element within the burner head housing part and defines a combustion air chamber of predetermined value between an inner surface of the sleeve member and an outer surface of the burner element; wherein said sleeve member forms a means for adapting the size of the combustion air chamber to the design and capacity of the heating device in a manner achieving an air flow to the burner element that is essentially independent of the configuration and arrangement of the burner head housing part.

* * * * *